United States Patent [19]

Wildeman, et al.

[11] 3,967,472

[45] July 6, 1976

[54] STITCH BONDED FABRICS

[76] Inventors: Arno Edgar Wildeman, Aurel House, Blueberry Road, Altrincham, Chester; David Brunnschweiler, 515 Preston New Road, Blackburn, Lancaster, both of England

[22] Filed: Dec. 10, 1973

[21] Appl. No.: 423,425

[30] Foreign Application Priority Data

Dec. 16, 1972 United Kingdom ..... 58206/72

[52] U.S. Cl. ..... 66/191; 66/196; 60/192; 66/85 A

[51] Int. Cl.[2] ..... D04B 7/12; D04B 7/14; D04B 9/14; D04B 13/00

[58] Field of Search ..... 66/85 A, 85, 86, 87, 66/194, 195, 190, 191, 192; 28/4 R, 72.2 R; 161/154, 89, 80; 428/234, 233, 300, 102, 253, 297

[56] References Cited

UNITED STATES PATENTS

| | | | |
|---|---|---|---|
| 3,260,640 | 7/1966 | Owen | 161/154 X |
| 3,309,901 | 3/1967 | Danhel et al. | 66/85 A |
| 3,310,964 | 3/1967 | Peschl et al. | 66/85 A |
| 3,337,387 | 8/1967 | Owen | 28/4 |
| 3,377,821 | 4/1968 | Vajda et al. | 66/85 A |
| 3,395,065 | 7/1968 | Owen | 161/80 X |
| 3,417,580 | 12/1968 | Scholtis et al. | 66/85 A |
| 3,616,124 | 10/1971 | Danhel et al. | 28/72.2 X |
| 3,616,658 | 11/1971 | Jindra et al. | 66/85 A |
| 3,643,301 | 2/1972 | Weigl et al. | 66/85 A X |
| 3,646,780 | 3/1972 | Wildeman | 66/85 A |
| 3,646,781 | 3/1972 | Scholtis et al. | 66/85 A |
| 3,769,815 | 11/1973 | Ploch et al. | 66/85 A |
| 3,819,469 | 6/1974 | Balch et al. | 66/85 A |

FOREIGN PATENTS OR APPLICATIONS

| | | | |
|---|---|---|---|
| 2,007,611 | 9/1970 | Germany | 66/85 A |
| 900,056 | 11/1953 | Germany | 66/85 A |

*Primary Examiner*—Ronald Feldbaum
*Attorney, Agent, or Firm*—Oblon, Fisher, Spivak, McClelland & Maier

[57] ABSTRACT

A fleece fabric is produced by first consolidating a fleece into a primary fabric by fleece knitting, and then stitch bonding the primary fabric with warp yarn.

The fabric is at least as strong and stable as ordinary stitch bonded fabrics, but has substantially improved pilling and abrasion resistance, and a much wider range of patterning and surface texture possibilities.

18 Claims, 8 Drawing Figures

STITCH BONDED FABRICS

The invention relates to the production of fleece fabrics by stitch bonding, that is to say the consolidation of a fibrous fleece by the incorporation of fleece fibres into knitted stitch loops.

BACKGROUND TO THE INVENTION

Fleece fabrics are conventionally produced in any one of a variety of ways, of which two examples are fleece knitting and warp yarn stitch bonding. In fleece knitting, fleece produced for example by a card and cross folder or a pneumatic fleece layer is fed to a stitchbonding head equipped with compound needles in a reciprocatory bar. The needles pull out loops of fleece fibres and form quasi-chain stitch seams by pulling each so formed loop through the previously formed loop. This process produces a fabric which has considerably more strength than the original fleece, but which lacks sufficient strength, even after stentering, to be useful as a textile face fabric. Its stability, its pilling properties and its abrasion resistance are not very good. It finds application as an interlining, or it can be further processed for example by thermobonding or by coating with polyvinyl chloride for use as a leather substitute.

Stitch bonding, on the other hand, with warp yarn more readily provides a useful fabric of adequate strength and stability, for use as a face fabric. In this process, the fleece is produced as in fleece knitting and fed to the stitch bonding head where chain, tricot or other stitch seams such as those used in warp knitting are produced by the compound needles from warp yarns which are laid in the open needle hooks when they penetrate through the fabric.

Such fabrics, although possessed of superior properties in some respects when compared to fleece knitted fabrics, still lack many essential qualities for use as regular textile fabrics. Thus while warp yarn stitch bonded fabrics can be made with adequate strength, especially if long (i.e. about 10 cm) fibre is used in the fleece and the fabrics are stentered, the simple chain stitches produced by a single guide bar machine are easily pulled out to form a ladder. This disadvantage can be overcome by using more complicated stitch formations produced by multiple guide bar machines at the expense, however, of productivity. It has also been proposed to lock the warp yarn stitches by loops of fleece fibers (see U K patent specifications NOS. 1 268 630 and 1 316 013 ) and fabrics produced in this way are already an article of commerce. Even these improved fabrics however have certain disadvantages when compared to woven or circular or warp knitted fabrics constructed entirely of yarn.

Since the warp yarn stitches are required to bond the fleece fibre together, and give strength to the structure, the possibilities of deploying the warp yarn stitches to create interesting surface texture or patterning effects are limited. Thus needles might be spaced in groups to create a pattern of lines running lengthways of the fabric, but the spacing between two adjacent seams cannot be too great or fabric strength will be seriously affected. Furthermore, the pilling and abrasion resistance of warp yarn stitchbonded — as of fleece fabric generally — are extremely poor. Thus where a standard pilling test ascribed a value of 1 to a fabric with good pilling properties, a value of 2 to a fabric with intermediate pilling resistance and a value of 3 to a badly pilling fabric, it is necessary to extend this range and ascribe a value of 4 to many stitch bonded fabrics, which exhibit pilling to an extent which can more properly be described as matting.

SUMMARY OF THE INVENTION

It has now been found possible, by the present invention, to produce a warp yarn stitchbonded fabric having good pilling and abrasion resistance in a much wider variety of patterns and textures and thus avoid many of the disadvantages of fleece fabrics produced hitherto and extend the range of application of such fabrics to textile uses from which they had previously been excluded.

The invention comprises in one aspect a method of producing a fleece fabric by stitchbonding, in which a fleece is first consolidated by fleece knitting into a primary fabric which is then further stitchbonded with warp yarn. Although the warp yarn stitchbonding can be carried out continuously with the production of the primary fabric, it is preferred that it is performed, as is usual, continuously with the production of the fleece.

The warp yarn stitchbonding may be performed by running the primary fabric with its loop or face side or its plain or reverse side towards the warp yarn supply, giving two patterning or surface texture possibilities, and may be performed by running the primary fabric in the same or the opposite direction, with respect to the needle bed, as the fleece ran with respect to the fleece knitting needle bed, thus giving two further possibilities.

The primary fabric, however, might be fleece knitted twice, so as to have loops on both faces.

The warp yarn stitch bonding may be carried out with the same needle spacing as the fleece knitting, or a different needle spacing.Likewise, the stitch length may be the same as or different from that produced during the fleece knitting.

Pile loops may be produced during the warp yarn stitch bonding.

The warp yarn stitch bonding may comprise simple chain stitch knitting or tricot or other stitch knitting, and may be performed on a single or a multiple guide bar machine.

Two or more primary fabrics may be stitch bonded together, of which at least one comprises a fleece knitted fabric.

All of these measures give rise to further possibilities for producing original patterns or surface textures. Further possibilities arise when, instead of, as is usual, arranging that all the warp yarns have the same tension, at least one group of warp yarns is arranged to have a different tension from at least one other group. This is possible since the warp yarns are not now the sole means by which the fabric is consolidated and wider tension adjustment is therefore permitted.

Very useful fabrics are obtained when the primary fabric is produced from a fleece in which the fibres have at least a partial orientation transverse to the direction of stitch propagation, for example, when the fleece is produced by the conventional card and cross folder. The fleece may also be produced by a pneumatic fleece layer, or the fibres may be presented to the needle bed on a brush or a set of oscillating bristles or pins.

The invention also comprises a fleece fabric comprising a fleece knitted primary fabric overknitted with warp yarn stitches. The fleece fabric may comprise two or more primary fabrics, at least one of which is a fleece knitted fabric, bonded together with warp yarn stitches.

The primary fabric stitches may be to a gauge of between 3 and 32 per inch, whereas the warp yarn seams may be to a gauge of between 2 and 20 per inch. The primary fabric stitches and warp yarn seams may be to the same or different gauges, and it may be preferred to have the warp thread stitches to a finer or a coarser gauge than the fleece knitting stitches. Likewise, the warp thread stitch length may be greater or less than the fleece knitting stitch length.

The invention also comprises plant for the production of fleece fabric comprising a fleece knitting machine and a warp yarn stitch bonding machine and means feeding to the warp yarn stitch bonding machine fleece knitted fabric produced by said fleece knitting machine. There is preferably an intermediate primary fabric take-up and store.

BRIEF DESCRIPTION OF THE DRAWINGS

Embodiments of fleece fabrics and methods and plant for producing them according to the invention will now be described with reference to the accompanying drawings in which.

DESCRIPTION OF THE PREFERRED EMBODIMENTS

Figure 1:
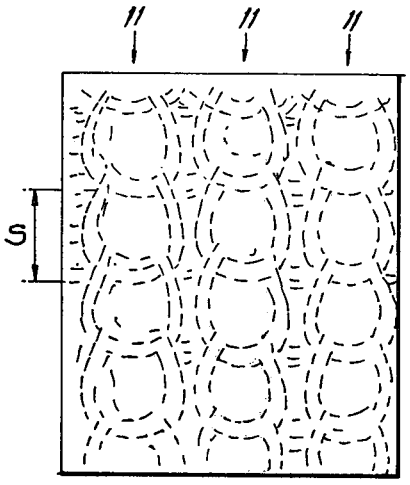
FIG. 1 is a diagrammatic illustration of a fleece knitted fabric of the prior art.

The fleece knitted fabric illustrated in FIG. 1 is shown essentially by the outline of its stitch loops on the face side. Such a fabric may be produced by known machinery such as the Malivlies machine manufactured by VEB Naehwirkmaschinenbau Karl-Marx-Stadt, or by other similar machinery, in which a row of compound needles mounted in a reciprocatory needle bar penetrate a fleece and pull out groups of fibres in loops, knitting each loop into the preceding loop. A typical fleece knitted frabric may have between three and thirty two quasi-chain stitch seams 11 per inch, and have a stitch length *s* of between 0.5 and 5.0 mm.

Figure 2:
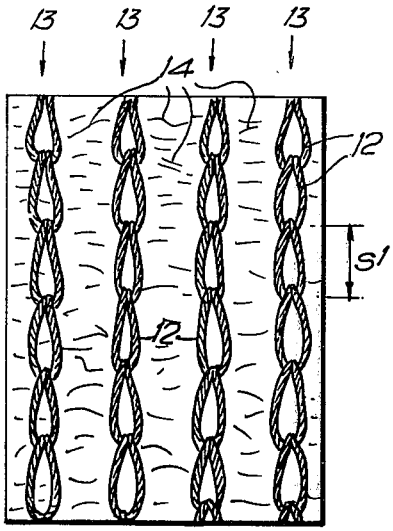
FIG. 2 is a diagrammatic illustration of a warp yarn stitch bonded fabric of the prior art, FIGS. 3 to 6 inclusive are diagrammatic illustrations of warp yarn stitchbonded fabrics according to the invention.

The warp yarn stitch bonded fabric illustrated in FIG. 2 is shown from the loop side of the warp yarn stitches 12 binding together the fleece fibres 14. This fabric may typically be produced in 2 to 20 gauge, that is to say with from 2 to 20 seams 13 per inch. The stitch length *s'* may be from 1 to 5 mm. The illustration shows a very simple stitch construction which consists simply of equally spaced rows of simple chain stitches. However, tricot stitches, or other constructions used in warp knitting may be used. Such fabric may be made on a single guide bar machine such as the Maliwatt machine, manufactured by VEB Naehwirkmashinenbau, or the two guide bar Arachne machine, for the more complicated stitch structures, manufactured by Elitex-Zavody textilniho strojirenstvi generalni reditelstvi of Liberec Czechoslovakia.

Figure 3:
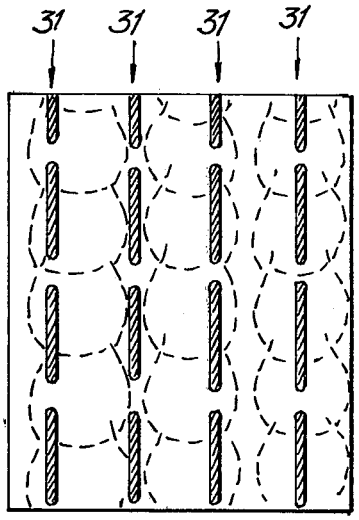

One fabric according to the invention, illustrated in FIG. 3, comprises a primary fabric, like that illustrated in FIG. 1, a fleece knitted fabric, overstitched with warp yarn seams 31. In this instance, the gauge and stitch length of the warp yarn stitches are both different from the fleece knitting. The warp yarn stitches are more densely packed across the width of the fabric, being, for example, 18 gauge as opposed to 14 gauge for the fleece knitting, but the stitch length of the warp seams is longer than that of the primary fabric fleece knitting, say 2 mm against 1.4 mm. On the other hand, the fleece knitting stitches could be to the finer gauge, or have the longer stitch length depending on the effect aimed at.

Figure 4:
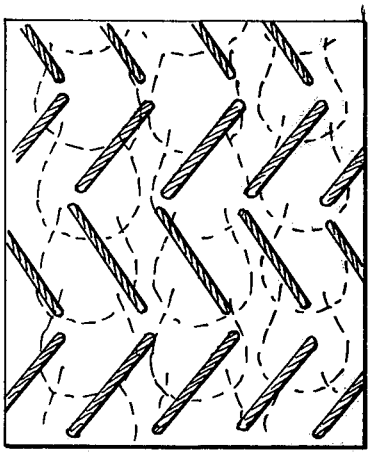

FIG. 4 shows a similar arrangement, but using tricot stitch warp yarn stitch bonding, in which the warp yarn guides which lay the yarns in the needle hooks reciprocate laterally so as to lay one yarn first in one needle hook and then, on the next needle penetration, ii the next adjacent needle hook, and then back again for the next penetration, and so on.

Figure 5:
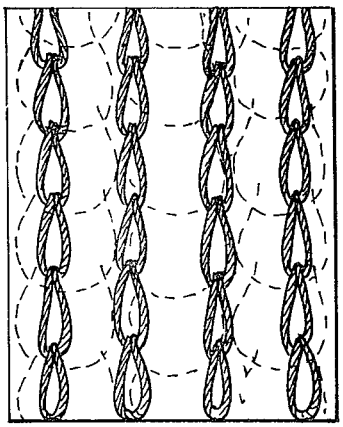
Figure 6:
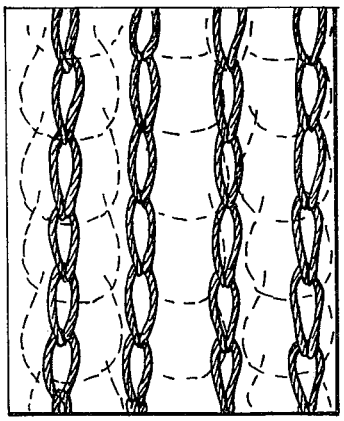

FIGS. 3 and 4 show the warp yarn seams on the side from which the warp yarns were supplied to the needles, that is to say, they show the opposite face to that shown in FIG. 2, which displays warp yarn loops. The loops on the reverse sides of the fabrics illustrated in FIGS. 3 and 4 would of course have warp yarn stitch loops like those, 12, of FIG. 2. The direction of propagation of the stitch chains may be the same or opposite to that of the stitches of the primary fabric. The loop side of the warp yarn knitting may be on the loop side or the plain side of the fleece knitting (or on either loop side, if the primary fabric is fleece knitted on both sides). FIGS. 3 and 4 illustrate fabrics in which the loop side of the yarn stitches is on the plain side of the primary fabric. FIGS. 5 and 6 illustrate fabrics in which the loop side of the warp stitching is on the loop side of the primary fabric. In FIG. 5, a fabric is shown which has been warp yarn stitchbonded in the same direction it was fleece knitted — the yarn loops and the fibre loops point in the same direction. FIG. 6 shows a fabric in which the yarn loops point in the opposite direction to the fibre loops, made by running the primary fabric through the warp yarn stitch bonding machine in the reverse direction.

Figure 7:
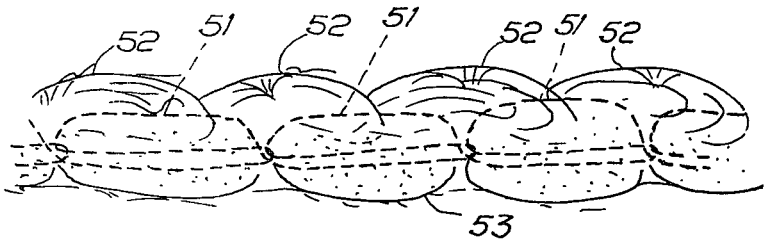
FIG. 7 is a lengthwise section through a fabric as illustrated in FIG. 3.

It may be arranged that the primary fabric is overfed into the warp yarn stitch bonding machine. In such operation the warp yarn tension is relatively high, and has the effect, illustrated in FIG. 7, of causing the warp yarn stitches 51 to sink inside the structure of the fleece knitted fabric and the fibre loops 52 of that fabric to compact and be accentuated in their stitch-like structure, on the face side. The reverse side 53 of the fleece fabric has a similar appearance to a conventional warp yarn stitch bonded fabric.

Figure 8:
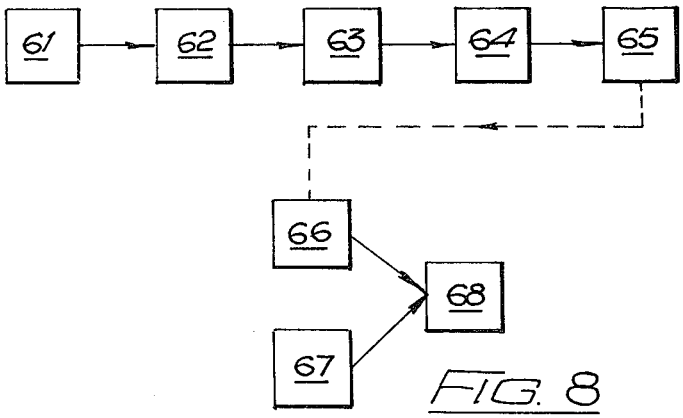
FIG. 8 is a diagrammatic illustration of a plant for producing fabrics according to the invention.

FIG. 8 illustrates a plant for manufacturing the fleece fabrics of the invention. In the first stage of such manufacture, an opener 61 feeds fibre to a card 62 which deleivers a thin web of fibre to a cross folder 63 or other fleece preparation arrangement delivering a thick fleece to a fleece knitting machine 64 which delivers fleece knitted primary fabric to a wind-up roll or fabric folder and stacker 65.

The fleece fabric is then transferred to a fabric input 66 from where it is fed, together with warp yarn from a beam 67, to a warp yarn stitch bonding machine 68.

A stenter may be added, for increasing the width of the warp yarn stitch bonded fabric, and increasing simultaneously its widthwise strength, but this may be unnecessary in the case of many of the fabrics which can be produced according to the invention, which already have adequate widthwise strength and stability as they come off the warp yarn stitch bonding machine.

Clearly the intermediate wind-up or stacking step permits the primary fabric to be fed through the warp yarn stitch bonding process in the direction opposite to that in which it was produced by the fleece knitting process. It also allows it to be reprocessed in the fleece knitting machine 64 so that its two faces have stitch loops, and such re-processing may be done by passing the fabric through the fleece knitting machine in the same or in the opposite direction. Moreover, the fleece knitting conditions (gauge, stitch length) may be different.

Surprising advantages have been found in the novel fabrics produced in the manner described above, in particular as regards their strength and stability, which may be such as to require no subsequent stentering, and as regards their pilling and abrasion resistance, which can be substantially improved to be as good as conventional woven or knitted structures. Moreover, a much wider range of patterns and textures is achievable than with conventional warp yarn stitch bonded fleece fabrics.

Examples of fleece fabrics according to the invention and their manner of production will now be described:

EXAMPLE I

A 100% viscose fleece produced by carding and cross folding and having an average fibre length of approximately 10 cm. was fleece knitted on a Malivlies machine to 18 gauge with 3 mm stitch length. This primary fabric was then warp yarn stitch bonded, in a Maliwatt machine suitably adapted (by reducing the gap between the fabric support bar and the sinkers and adding cloth guides and feed rollers in place of the fleece feed arrangement) to receive the fleece knitted fabric instead of an unconsolidated fleece, with 167 dtex 30 filament polyester yarn to 14 gauge with 1.4 mm chain stitches. One fabric was produced in which the loop side of the yarn stitches was on the loop side of the primary fabric, and another in which the loop side of the yarn stitches was on the plain side of the primary fabric.

Both fabrics had similar properties and appearance, which was improved over that of an unprocessed fleece stitch bonded to the same specification. The pilling resistance was noticeably improved on the face side, i.e. the side having the fibre loops. The fabrics were suitable for curtains.

EXAMPLE II

A 40% polyester/60% viscose fleece was fleece knitted with 18 gauge 2 mm stitches, then overstitched with a 30 filament 167 dtex polyester yarn in 14 gauge 1.2 mm chain stitches having their loop side on the plain face of the primary fabric.

Without stentering, the properties of the fabric were similar to a stentered fabric produced by warp yarn stitch bonding an unprocessed fleece to the same specification. The surface appearance however was greatly improved, while the pilling resistance on the face side was also improved. The abrasion resistance on the face side was better than a resin finished tricot fabric of the same weight, with 0.8 mm tricot stitches.

EXAMPLE III

A 100% polyester fleece was fleece knitted with 18 gauge 2 mm stitches, and then overstitched with 167 dtex 30 filament polyester in 14 gauge 1.0 mm tricot. The pilling properties of this fabric were very good, and it had a high abrasion resistance. Its tensile strength was high both lengthwise and widthwise, and it had a high burst strength. It was suitable for apparel — jackets, skirts and the like — as well as for furnishing fabrics, and as a substrate for polyvinyl chloride coated fabrics. It is also very useful for electrode pockets in lead-acid storage batteries.

All these fabrics had high density. Because the fleece fabric is already consolidated prior to warp yarn stitch bonding, it is possible to pack into the finished fabric more fibre than when using unprocessed fleece. The fabric appears more uniformly dense than conventional fleece fabrics, and this makes the fabric more suitable for critical textile end uses.

Two or more fabrics may be warp yarn stitch bonded together in the stitch bonding machine 68. Thus two fleece knitted fabrics may be stitch bonded together back to back to expose fibre loops on both faces of the composite fabric. A fleece knitted fabric may be stitch bonded to a knitted or woven fabric of scrim, or to a foam fabric.

The fabrics may be conventionally coloured or patterned as by dyeing, printing, heat transfer and the like. Because of the improved uniformity and surface texture of the fabrics, improved results are to be expected from such colouring processes.

Pile loops may be produced on the fabric by suitably tensioning the warp yarns. For example alternate warp yarns may be overfed or may be fed at a low tension compared to their adjacent yarns. This produces a pile fabric of uniformly rough appearance. Patterning can be added by having bands of adjacent yarns all normally tensioned, to produce line or regions without pile. Weft way running no-pile lines or areas can be produced by intermittently tensioning and de-tensioning groups of warp yarns.

We claim:

1. A method for producing a fleece fabric comprising the steps of:

a. consolidating a fleece into a primary fabric by fleece knitting said fleece with a first set of stitches formed solely from groups of fibers of said fleece; and b. subsequently stitch bonding the primary fabric with a second independent set of stitches of warp yarn.

2. A method in accordance with claim 1, wherein the fleece knitting and warp yarn steps are performed discontinuously.

3. A method in accordance with claim 2, wherein said primary fabric is fed through said warp yarn stitch bonding step in the opposite direction to that in which it was produced in the fleece knitting step.

4. A method in accordance with claim 1, wherein the primary fabric is fed through said warp yarn stitch bonding step in the same direction as it was produced in the fleece knitting step.

5. A method in accordance with claim 1, wherein the step of consolidating results in the primary fabric having loops on both faces.

6. A method in accordance with claim 1, wherein pile loops are formed during the warp yarn stitch bonding step.

7. A method in accordance with claim 1, wherein the primary fabric is stitch bonded to at least one other fabric with said warp yarn.

8. A method in accordance with claim 1, including the step of preselecting the tensions of the warp yarns to produce patterning and surface texture effects in the fabric.

9. A method of producing a fleece fabric comprising the steps of a. producing a fleece b. consolidating said fleece into a primary fabric by fleece knitting said fleece with a first set of stitches solely consisting of groups of fibers of said fleece, and c. subsequently stitch bonding the primary fabric with a second independent set of stitches of warp yarn.

10. A method in accordance with claim 9, wherein the step of consolidating said fleece is done continuously with the production thereof.

11. A method in accordance with claim 10, wherein the fleece knitting and warp yarn stitch bonding steps are performed discontinuously.

12. A method in accordance with claim 1, wherein the primary fabric produced by the step of consolidating has a plain side and a loop side, and the step of stitch bonding the primary fabric comprises stitches having a plain side and a loop side.

13. A method in accordance with claim 12, wherein the warp yarn stitch bonding is carried out in such manner that the warp yarn stitch loop side is on the primary fabric plain side.

14. A method in accordance with claim 12, wherein the warp yarn stitch bonding is carried out in such manner that the warp yarn stitch loop side is on the primary fabric loop side.

15. A fleece fabric formed from a fleece, comprising:

a fleece knitted primary fabric having a first set of stitches solely consisting of groups of fibers of said fleece; and having a second set of stitches of warp yarn independent of, and disposed over, said first set of stitches at least some of the stitches of said second set being non-coincident with the stitches of said first set.

16. A fleece fabric in accordance with claim 15, wherein the stitches have a first stitch length, said fabric being overstitched with warp yarn stitches having a second stitch length different from said first stitch length.

17. A fleece fabric in accordance with claim 15, wherein the stitches are to a first gauge, said fabric being overstitched with warp yarn stitches to a second gauge different from said first gauge.

18. A fleece fabric formed from a fleece comprising:

a fleece knitted primary fabric having a first set of stitches solely consisting of groups of fibers of said fleece; and at least one other fabric, said primary fabric and said other fabric being bonded together with a second independent set of warp yarn stitches at least some of the stitches of said second set being non-coincident with the stitches of said first set.

* * * * *